United States Patent [19]

Kuwabara et al.

[11] 4,350,023

[45] Sep. 21, 1982

[54] AIR CONDITIONING APPARATUS

[75] Inventors: Eiji Kuwabara, Fujishi; Takayoshi Sakata, Jufishi; Noboru Kawauchi, Shizuokashi; Yuuichi Ide; Takeshi Matsuo, both of Fujishi, all of Japan

[73] Assignee: Tokyo Shibaura Denki Kabushiki Kaisha, Kanagawa, Japan

[21] Appl. No.: 195,065

[22] Filed: Oct. 7, 1980

[30] Foreign Application Priority Data

Oct. 15, 1979 [JP] Japan ..... 54-132673

[51] Int. Cl.[3] ..... F25D 17/00; B01F 3/02

[52] U.S. Cl. ..... 62/176 E; 62/180; 236/44 C

[58] Field of Search ..... 236/44 C; 62/176.6, 62/93, 180; 165/21; 73/336, 336.5

[56] References Cited

U.S. PATENT DOCUMENTS 2,201,342 5/1940 Lydon et al. ..... 236/44 C 2,837,286 6/1958 Ross ..... 236/44 C

*Primary Examiner*—William E. Wayner

*Attorney, Agent, or Firm*—Cushman, Darby & Cushman

[57] ABSTRACT

An air-conditioning apparatus automatically selects one of three operational modes and operates at one of three operational zones defined by a combination of the temperature and the humidity to establish thermally comfortable conditions. In the cooling zone, the air conditioning apparatus operates to control the temperature to lower the temperature; in a dehumidifying zone it operates to control the humidity to lower the humidity; in a fan zone it operates to stir the air to maintain thermally comfortable conditions. The air conditioning apparatus includes an operational mode controller which senses the temperature and humidity and changes the operational mode based upon the sensed temperature and the sensed humidity.

3 Claims, 4 Drawing Figures

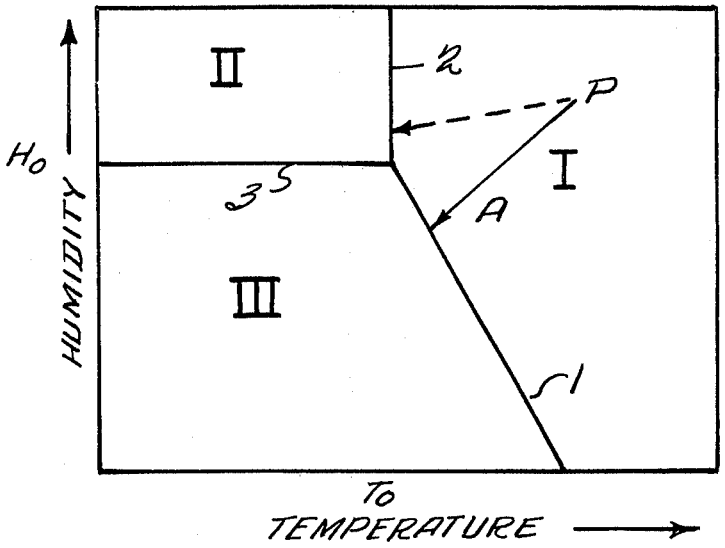
FIG. 1
FIG. 2
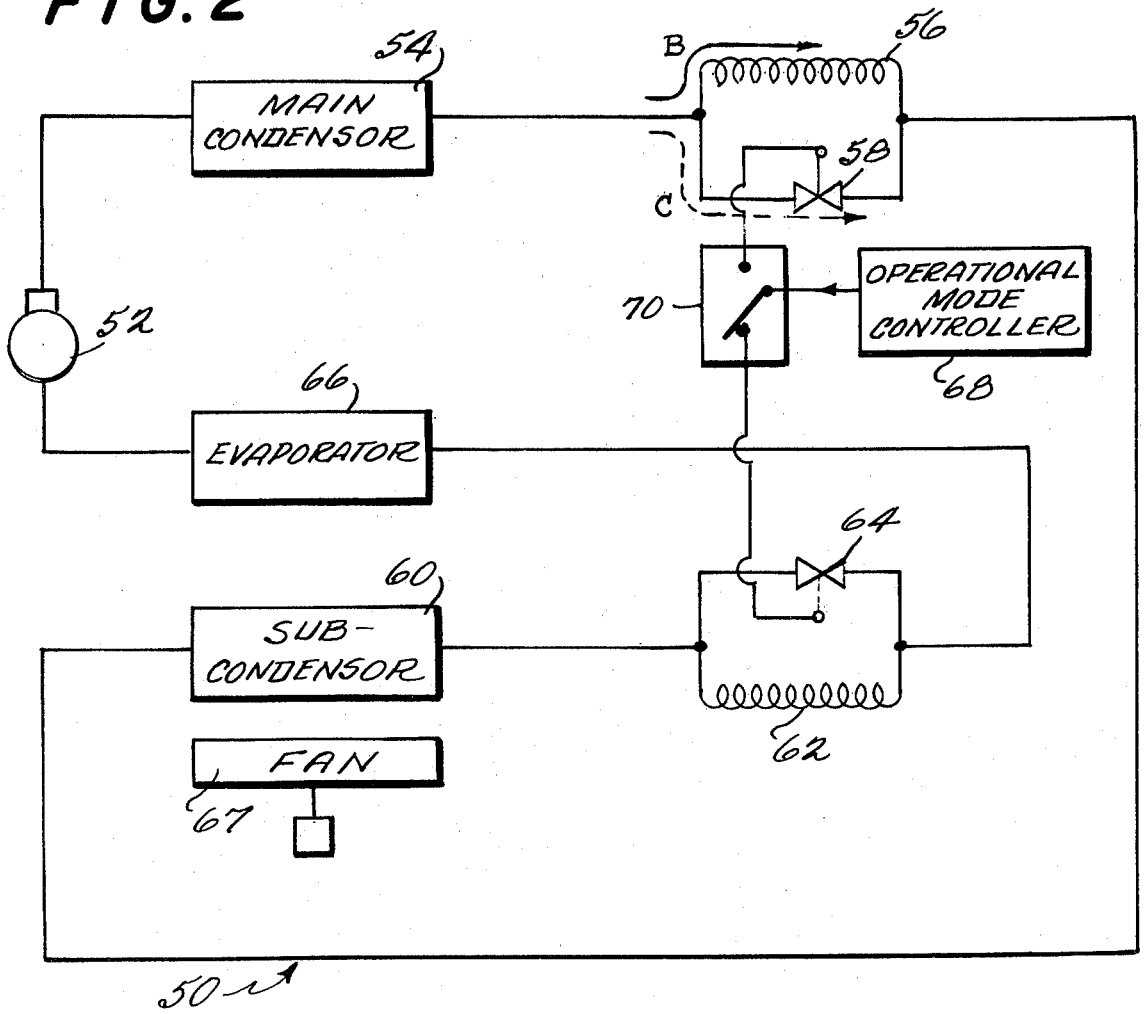

AIR CONDITIONING APPARATUS

BACKGROUND OF THE INVENTION

This invention relates to an air conditioning apparatus which establishes thermally comfortable conditions defined by the combination of temperature and humidity.

BACKGROUND OF THE PRIOR ART

The purpose of an air conditioning apparatus is to establish thermally comfortable conditions. In conventional air conditioning apparatus, control of comfortable conditions was attempted by controlling the temperature. In summer, for example, lowering of the temperature was accomplished by a cooling device without any consideration of humidity. Accordingly, a relatively large temperature difference often exists between an air-conditioned place and a non-air-conditioned place. Such a temperature difference is not only unhealthful, but also uncomfortable.

To eliminate such problems, Japanese patent application No. 50-79691 to MATSUSHITA DENKI SANGYO K.K. teaches a use of a temperature sensor and a humidity sensor for generating an electrical signal to energize a cooling device, a dehumidifying device or both of them to establish and maintain thermally comfortable conditions from the well known fact that such conditions are established by properly controlling both temperature and the humidity.

SUMMARY OF THE INVENTION

The present invention provides an improved air conditioning apparatus which establishes thermally comfortable conditions by controlling flow of the refrigerant in order to automatically change its operational mode from one to another, such as from a cooling mode to a dehumidifying mode or vice-versa, according to temperature and humidity.

BRIEF DESCRIPTION OF THE DRAWINGS

FIG. 1 shows a graph illustrating the operatonal zones in which an air conditioning apparatus of the present invention operates as a cooler, a dehumidifier or a fan;

FIG. 2 shows a refrigerant cycle of the air conditioning apparatus;

DETAILED DESCRIPTION OF A PREFERRED EMBODIMENT

Figure 3:
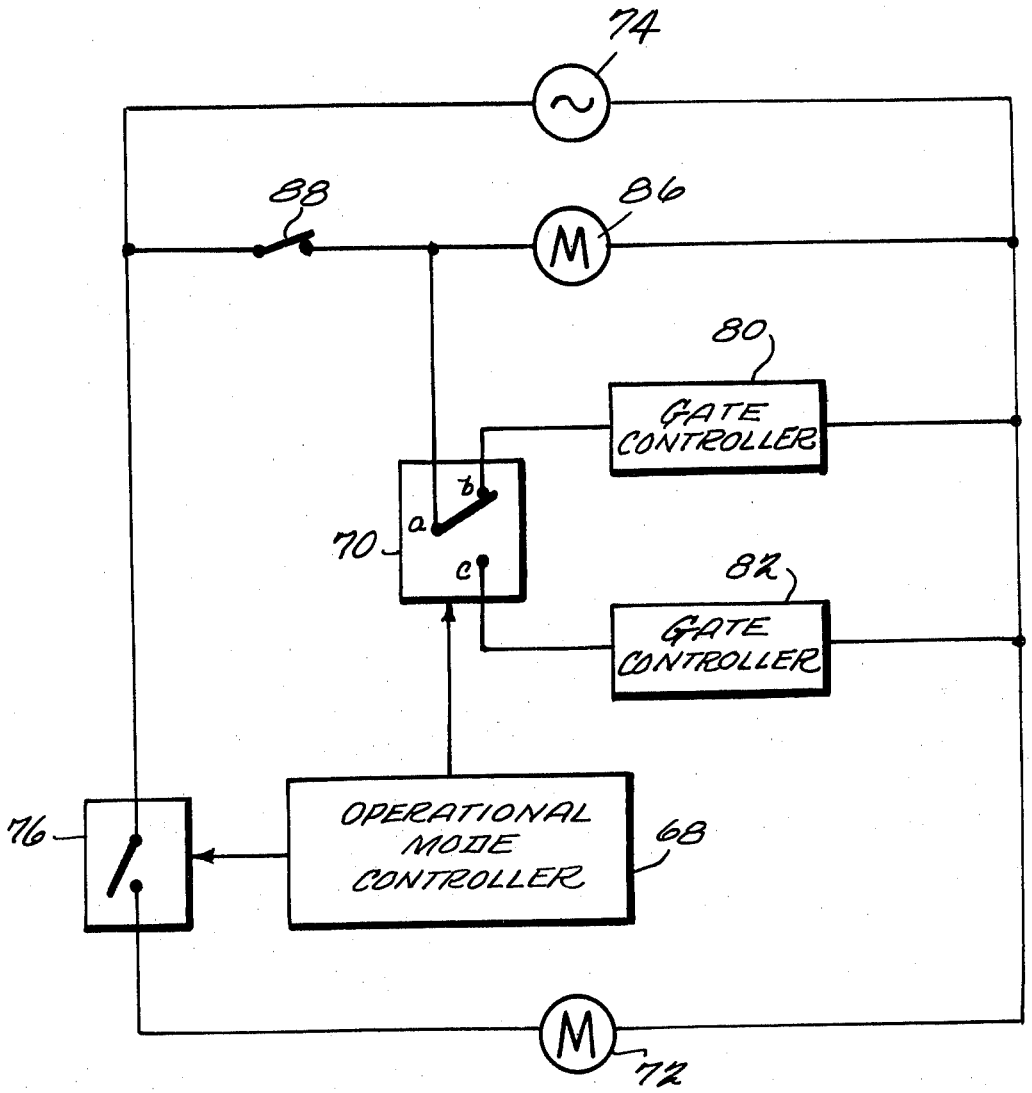
FIG. 3 shows a wiring diagram for the air conditioning apparatus.

An air conditioning apparatus of the present invention operates in one of three zones as shown in FIG. 1 according as the temperature and humidity. These zones are a cooling zone I, a dehumidifying zone II, and a fan or a comfortable zone III. In cooling zone I, the apparatus operates in a cooling mode to lower the temperature. In dehumidifying zone II, the apparatus operates in a dehumidifying mode to lower the humidity. In fan zone III, the apparatus operates only as a fan to stir the air to maintain the comfortable conditions.

A boundary line between cooling zone I and fan zone is called equal comfortable control line 1. The equal comfortable line 1 is expressed by the following equation:

$$H+\gamma \cdot T=\beta \quad (1)$$

where H is humidity, T is temperature, and $\gamma$ and $\beta$ are constants, respectively.

The boundary line between cooling zone I and dehumidifying zone II is named as a cooling-dehumidifying line 2 which is expressed by the following equation:

$$T=T_o \quad (2)$$

where $T_o$ is a fixed temperature.

The boundary line between dehumidifying zone II and fan zone II is a dehumidifying control line 3 which is expressed by the following equation:

$$H=H_o \quad (3)$$

where $H_o$ is fixed humidity.

Accordingly, a crossing point of three lines 1, 2, and 3 has coordinates ($T_o$, $H_o$).

If the apparatus starts operation at P in cooling zone I, it works as a cooler which lowers the temperature. As a cooler, it also lowers the humidity. The apparatus lowers the temperature and humidity until its operational point reaches to equal comfortable line 1 as indicated at locus A of the operational points, shown in FIG. 1, if the humidity is kept below $H_o$. When the operational point reaches line 1 the apparatus changes its mode from the cooling mode to the fan mode. The operational point may then go back into the cooling zone I because of rise of temperature or humidity or both. Accordingly, the apparatus works along equal comfortable line 1 to maintain the comfortable conditions.

Locus A might reach cooling-dehumidifying line 2 as shown by the dotted curve in FIG. 1 instead of line 1 depending upon the latent heat load. In such a case, the apparatus operates as a dehumidifier and it lowers the humidity to a predetermined level $H_o$ if the temperature is kept at $T_o$.

Similarly, when the apparatus starts operation in dehumidifying zone II, it words as a dehumidifier which lowers the humidity to $H_o$. When the operational point reaches line 3, the apparatus works as a fan for stirring the air.

The operational point of the apparatus is greatly dependent upon the latent heat load. However, the apparatus selects one of the operational modes automatically to establish or maintain thermally comfortable conditions.

FIG. 2 shows a refrigerant cycle of the apparatus 50. A compressor 52 is provided to compress gaseous refrigerant to form liquid refrigerant. Compressor 52 pumps out the liquid refrigerant to a main condensor 54 connected to a capillary tube 56 functioning as an expandor. A two-way electromagnetic valve 58 is connected in parallel with capillary tube 56. A sub-condensor 60 is connected to capillary tube 56 and electromagnetic valve 58. When electro-magnetic valve 58 is closed, the refrigerant flows into capillary tube 56 as indicated by a solid arrow B and its pressure is lowest thereat. Such expanded refrigerant can now evaporate at sub-condensor 60 and cool the air. On the other hand, when electromagnetic valve 58 is open, the refrigerant flows in electromagnetic valve 58 as indicated by dotted arrow C and further flows in sub-condensor 60 without lowering its pressure as it passes through valve 58. Such refrigerant is further condensed to generate heat at sub-condensor 60.

Another capillary tube 62 is connected to sub-condensor 60, which functions as an expandor of condensed refrigerant. A two-way electromagnetic valve 64 is connected in parallel with capillary tube 62, which is closed when electromagnetic valve 58 is open and vice-versa. An evaporator 66 is connected to capillary tube 62 and electromagnetic valve 64. Evaporator 66 cools air, and when the cooled air is warmed by heat generated at such condensor 60, moisture is given up. Thus, when the refrigerant flows in valve 58 so that temperature remains unchanged, only the humidity is lowered. When the refrigerant flows in valve 64, air is cooled both at sub-condensor 60 and evaporator 66. Vaporized refrigerant then returns to compressor 52. A fan 67 is provided for stirring the air. A temperature-humidity controller or an operational mode controller 68 senses the temperature and the humidity and controls electromagnetic valves 58 and 64 by a switch 70. Thus, apparatus 50 changes between the cooling mode and the dehumidifying mode by opening or closing electromagnetic valves 58 and 64.

FIG. 3 is a wiring diagram of apparatus 50. A motor 72 of compressor 52 is energized by a power source 74 when a switch 76 is closed. Opening or closing of switch 76 is controlled by operational mode controller 68 on which detailed explanation will be made below with accompanying FIG. 4. When apparatus 50 operates in either cooling zone I and dehumidifying zone II, switch 76 is closed. Gate controllers 80 and 82 of electromagnetic valves 58 and 64 are selectively energized by switch 70 which normally closes its contacts (a-b) so as to normally close valve 58 while another contacts (a-c) are normally opened so as to normally open valve 64. When switch 70 is energized, its contacts (a-b) are opened and contacts (a-c) closed. A motor 86 of fan 67 is normally energized by power source 74 through a normally closed switch 88.

Figure 4:
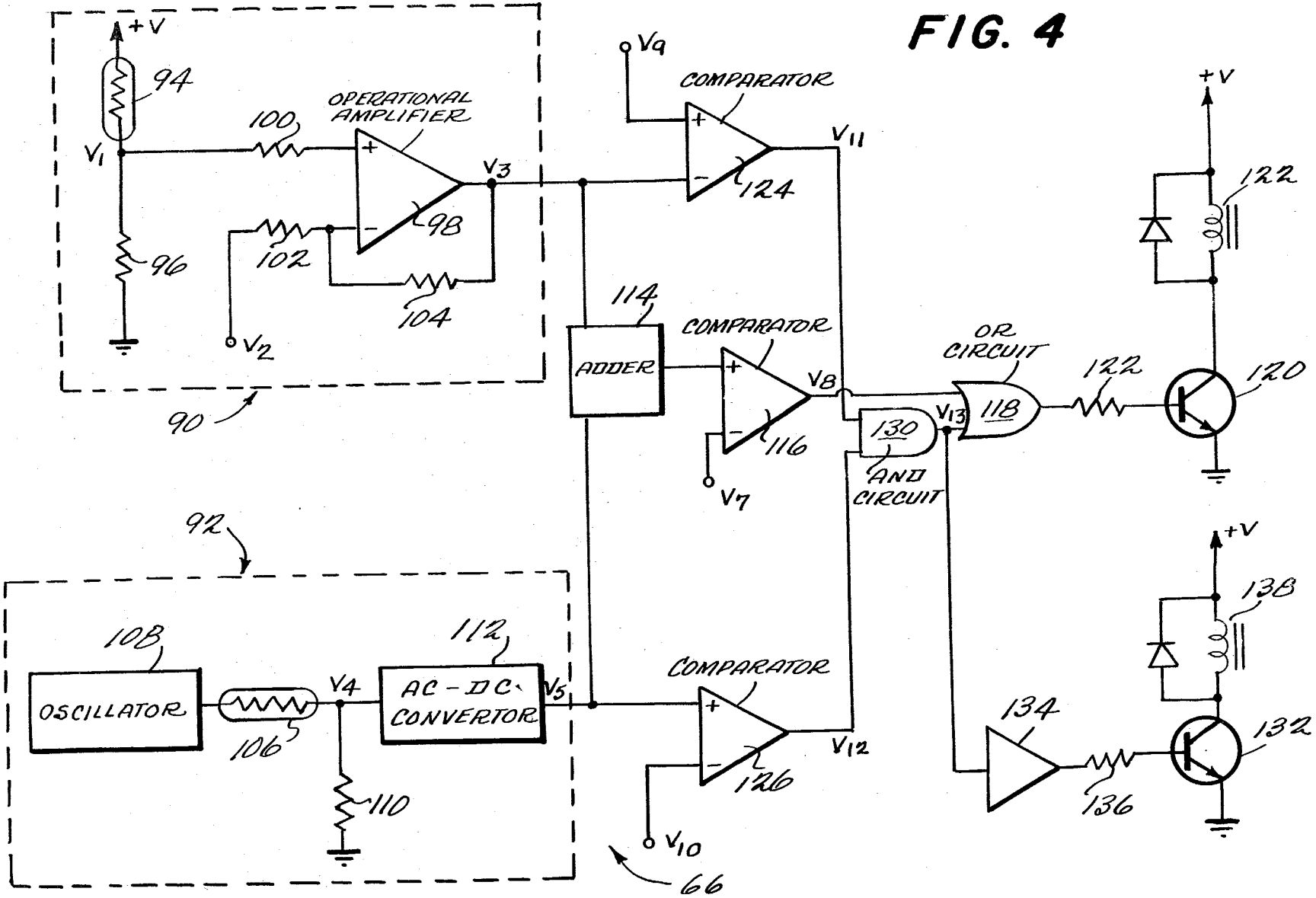
FIG. 4 shows an operational mode controller of the air conditioning apparatus.

FIG. 4 shows operational mode controller 68 which includes a temperature sensor 90 and a humidity sensor 92. In temperature sensor 90, a positive temperature coefficient resistor 94 is provided. A d-c voltage V is divided by resistor 94 and a resistor 96. Divided voltage $V_1$ is applied to a non-inverted terminal of an operational amplifier 98 through a resistor 100. A constant voltage $V_2$ is applied to an inverted terminal of operational amplifier 98 through a resistor 102. A resistor 104 which is connected between the inverted terminal and an output of operational amplifier 98 is called a feedback resistor. An output voltage $V_3$ is expressed as follows:

$$V_3 = \frac{V_1 + (V_1 - V_2)R_{104}}{R_{102}} \quad (4)$$

where $R_{102}$ and $R_{104}$ are values of resistors 102 and 104, respectively.

It is understood from equation (1) that output voltage $V_3$ is proportional to input voltage $V_1$. Namely, if desired, detected temperature T can be expressed as follows:

$$V_3 = \gamma \cdot T \quad (5)$$

where $\gamma$ is the constant used in equation (1).

The humidity is detected by humidity sensor 92 which converts the humidity to electrical signals. Humidity sensor 92 has a negative temperature coefficient resistor 106 of which impedance decreases when the humidity decreases. An alternate voltage produced by such as a Wien bridge oscillator 108 is divided by resistor 106 and a resistor 110. A divided voltage $V_4$, is applied as an input voltage to an AC-DC converter 112.

Detected humidity H can also be expressed as follows:

$$V_5 = H \quad (6)$$

An adder 114 which has two input terminals operates the following operation:

$$V_3 + V_5 = V_6 \quad (7)$$

A comparator 116 compares output voltage $V_6$ of adder 114 with a constant voltage $V_7$ which is set to the sum of $\gamma \cdot T_o$ and $H_o$. From equation (1), sum of $\gamma \cdot T_o$ and $H_o$ equals $\beta$. If output voltage $V_6$ is less than constant voltage $V_7$ ($V_6 \leqq V_7 = \beta$), no output is generated at comparator 116. On the other hand, if output voltage $V_6$ is greater than constant voltage $V_7$ ($V_6 > V_7$), an output voltage $V_8$ is generated and is applied to one of input terminals of an OR circuit 118. An output terminal of OR circuit 118 is connected to a transistor 120 through a resistor 122. OR circuit 118 generates an output to turn on transistor 120 for energizing a relay 122 to close switch 76.

Output voltage $V_3$ is applied to a comparator 124 and is compared with a constant voltage $V_9$ which is set at $\gamma \cdot T_o$. Comparator 124 generates an output voltage $V_{11}$ when output voltage $V_3$ is less than constant voltage $V_9$ ($V_3 \leqq V_9$). Output voltage $V_5$ is also compared at a comparator 126 with a constant voltage $V_{10}$ which is set at $H_o$. Comparator 126 generates an output voltage $V_{12}$ when output voltage $V_5$ is greater than constant voltage $V_{10}$ ($V_5 \geqq V_{10}$).

Both output terminals of comparators 124 and 126 are connected to an AND circuit 130 of which an output terminal is connected to the other input terminal of OR circuit 118 and to a transistor 132 through a buffer amplifier 134 and a resistor 136. When AND circuit 130 receives two inputs at the same time, it generates an output voltage $V_{13}$ which turns on transistors 120 and 132 for energizing relay 122 and a relay 138 to close contacts (a-c) of switch 70.

Accordingly, operations of compressor 52, electromagnetic valves 58 and 64 and fan 67 of an air conditioning apparatus 50 under certain combinations of the temperature and humidity are shown by the table below.

As set forth therein, the air conditioning apparatus of the present invention selects the operational mode automatically according to the temperature and humidity to operate as a cooler, a dehumidifier or a fan by controlling a flow of the refrigerant, and it prevents excessive cooling and establishes and maintains the thermally comfortable conditions defined by the combinations of the temperature and the humidity. As the thermally comfortable conditions are obtained by controlling both the temperature and humidity, the compressor of the air conditioning apparatus of the present invention is expected to work intermittently rather than continuously working, which contributes to saving of energy.

TABLE

| Zone | Temperature Humidity | Compressor 52 | Fan 68 | Valve 58 | Valve 64 | Mode |
|---|---|---|---|---|---|---|
| I | $T \geqq T_o$ $H \geqq H_o$ or $H < H_o$ | ON | ON | CLOSED | OPEN | COOLING |
| II | $T < T_o$ $H \geqq H_o$ | ON | ON | OPEN | CLOSED | DEHUMIDIFYING |
| III | $T \geqq T_o$ or $T < T_o$ $T < H_o$ | OFF | ON | CLOSED | OPEN | BLOWING |

What is claimed is:

1. An operational mode controller for an air-conditioning apparatus for controlling the temperature and the humidity comprising:

a temperature sensor for sensing temperature to produce a first signal substantially corresponding to said temperature;

a humidity sensor for sensing humidity to produce a second signal substantially corresponding to said humidity;

means for combining said first signal and said second signal to produce a third signal substantially corresponding to a sum of said temperature and said humidity;

means for comparing said first signal, said second signal and said third signal respectively with a given first signal substantially corresponding to a given temperature, a given second signal substantially corresponding to a given humidity and a given third signal substantially corresponding to a given sum of said given temperature and said given humidity; and an actuating means responsive to said comparing means for actuating said air conditioning apparatus for controlling the temperature when said temperature and said humidity exceed said given temperature and said given humidity while said sum exceeds said given sum, for controlling the humidity when said humidity exceeds said given humidity while said temperature is below said given temperature and for stopping control of both the temperature and the humidity when both said temperature and said humidity are below said given temperature and said given humidity while said sum is below given sum.

2. An operational mode controller for an air-conditioning apparatus for controlling the temperature and the humidity as in claim 1, wherein said comparing means includes:

a first comparator for comparing said first signal with a given first signal to produce a first output signal, when said first signal is below said given first signal;

a second comparator for comparing said second signal with a given second signal to produce a second output signal when said second signal exceeds said given second signal; and a third comparator for comparing said sum with said given sum to produce a third output signal when said sum exceeds said given sum.

3. An operational mode controller for an air-conditioning apparatus for controlling the temperature and the humidity as in claim 2 wherein said actuating means includes:

an AND circuit for producing a fourth output signal when received both said first output signal and said second output signal; and an OR circuit for producing a fifth output signal when received either said third output signal or said fourth output signal.

* * * * *